US010517398B2

(12) United States Patent
Sosso et al.

(10) Patent No.: US 10,517,398 B2
(45) Date of Patent: Dec. 31, 2019

(54) ADJUSTABLE ANGLE SHELF BRACKET

(71) Applicant: The Marco Company, Fort Worth, TX (US)

(72) Inventors: Jerome F. Sosso, Ft. Worth, TX (US); Tony Amalathithada, Fort Worth, TX (US)

(73) Assignee: The Marco Company, Fort Worth, TX (US)

( * ) Notice: Subject to any disclaimer, the term of this patent is extended or adjusted under 35 U.S.C. 154(b) by 330 days.

(21) Appl. No.: 15/089,438

(22) Filed: Apr. 1, 2016

(65) Prior Publication Data

US 2017/0280874 A1 Oct. 5, 2017

(51) Int. Cl.
*A47B 96/07* (2006.01)
*A47B 96/06* (2006.01)
*A47B 57/04* (2006.01)

(52) U.S. Cl.
CPC ..... *A47B 96/07* (2013.01); *A47B 57/04* (2013.01); *A47B 96/061* (2013.01)

(58) Field of Classification Search
CPC ..... A47B 96/07; A47B 57/04; A47B 57/425; A47B 96/061; A47B 96/14
USPC ..... 248/242; 108/108, 147.17
See application file for complete search history.

(56) References Cited

U.S. PATENT DOCUMENTS 3,089,675 A * 5/1963 Lozier ..... A47B 57/045 108/6
3,093,094 A * 6/1963 Oztekin ..... A47B 57/045 248/242
3,167,037 A * 1/1965 Mapson ..... A47B 57/045 108/108
3,182,945 A * 5/1965 Sedo ..... A47B 57/045 211/187
3,273,847 A * 9/1966 Berman ..... A47B 57/425 248/243
3,417,872 A * 12/1968 Close ..... A47B 57/045 211/208
3,426,993 A * 2/1969 Johansson ..... A47B 57/045 211/135

(Continued)

OTHER PUBLICATIONS

"Drawing of bracket assembly believed to be on sale or in public use more than one year before the filing of the present application," The Marco Company, 1 page, Received Nov. 5, 2015.
Metal angle adjustable shelf brackets, Alibaba Group, 5 pages, accessed Apr. 1, 2016 http://www.alibaba.com/product-detail/Metal-angle-adjustable-shelf-brackets_1826736216.html?spm=a2700.7724857.29.70.f3baoN.

(Continued)

*Primary Examiner* — Kimberly T Wood
(74) *Attorney, Agent, or Firm* — Yee & Associates, P.C.

(57) ABSTRACT

A bracket assembly for attaching a shelf to a support structure at different angles. The bracket assembly comprises a bracket, an adjustment structure, and a locking structure. The bracket comprises a shelf support surface and a projecting portion with a notch extending from an attachment side of the bracket. The adjustment structure comprises a number of sides that are moveable between a plurality of different positions to change the shape of the notch in the projecting portion for attaching the bracket to the support structure at different angles. Different sides of the adjustment structure may be positioned to change the size of the notch for attaching the bracket to support structures with different thicknesses of material. The locking structure is configured to prevent movement of the adjustment structure when the adjustment structure is in position.

9 Claims, 8 Drawing Sheets

(56) References Cited

U.S. PATENT DOCUMENTS

| | | | | | |
|---|---|---|---|---|---|
| 3,572,626 | A * | 3/1971 | Bertschi | A47B 57/045 | 248/242 |
| 4,065,088 | A * | 12/1977 | Shell | A47B 57/045 | 248/242 |
| 4,205,815 | A * | 6/1980 | Sauer | A47B 57/42 | 211/192 |
| 5,063,715 | A * | 11/1991 | Goodman | A47B 57/16 | 211/192 |
| 5,116,007 | A * | 5/1992 | Von Gunton | A47B 57/42 | 108/108 |
| 5,460,345 | A * | 10/1995 | Trevaskis | A47B 57/00 | 211/175 |
| 6,302,282 | B1 * | 10/2001 | Gay | A47B 57/045 | 108/152 |
| 8,028,845 | B2 * | 10/2011 | Himes | A47B 47/021 | 211/103 |
| 2002/0027115 | A1 * | 3/2002 | Gay | A47B 57/045 | 211/187 |

OTHER PUBLICATIONS

Angle adjustable wall bracket for shelf support, Alibaba Group, 5 pages, accessed Apr. 1, 2016 http://www.alibaba.com/product-detail/Angle-adjustable-wall-bracket-for-shelf_60242189774.html?spm=a2700.7724857.29.130.84L1pd.

"179 Adjustable Angle Bracket (for 80 Standards)—Anodized," Cornerstone, Knape & Vogt, 3 pages, accessed Apr. 1, 2016 http://www.cabinethardware.com/179-Series-Adjustable-Angle-Bracket-p/1157.htm.

"14" Adjustable Tap-In Style Shelf Bracket—Chrome—Pkg Qty 25," Global Equipment Company Inc., 2 pages, accessed Apr. 1, 2016 http://www.globalindustrial.com/p/storage/Display-Store-Fixtures/Perimeter-Hardware/14-adjustable-tap-in-style-shelf-bracket-chrome?infoParam.campaignId=T9F&gclid=CPyc-cTU7csCFQ8yaQodYHIJiA.

"Shelf Bracket (Adjustable Downslant)," Reeve Store Equipment Co., 3 pages, accessed Apr. 1, 2016 http://reeveco.com/cgi-bin/fccgi.exe?w3execportal&cmd=stock&cmd=stock&which=pn&pn=43-8.

* cited by examiner

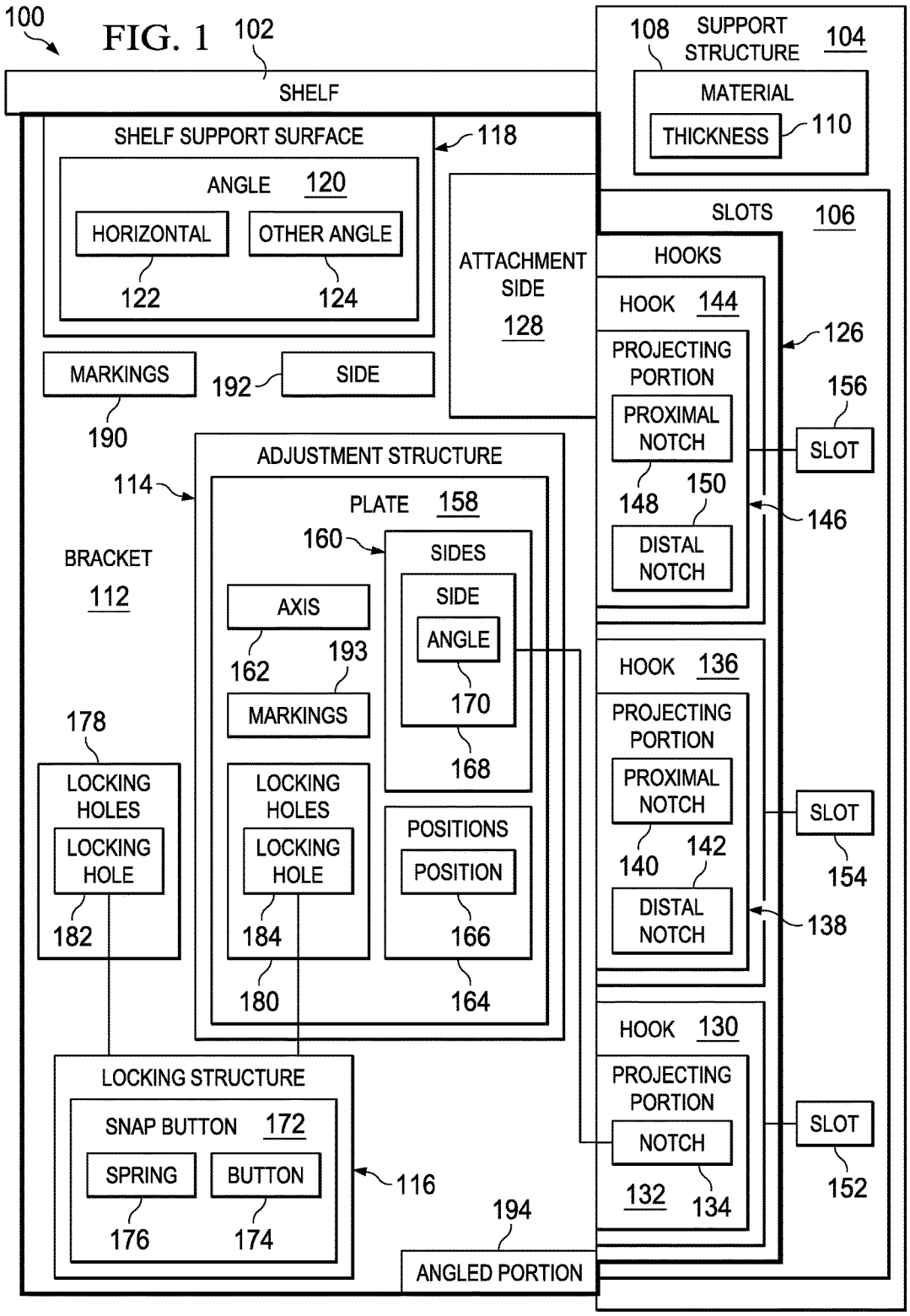
100
FIG. 1
102
SHELF
108
SUPPORT STRUCTURE
104
MATERIAL
THICKNESS
110
SHELF SUPPORT SURFACE
118
ANGLE
120
HORIZONTAL
OTHER ANGLE
122
124
ATTACHMENT SIDE
128
SLOTS
106
HOOKS
HOOK
144
PROJECTING PORTION
PROXIMAL NOTCH
DISTAL NOTCH
126
156
SLOT
148
150
146
MARKINGS
192
SIDE
190
ADJUSTMENT STRUCTURE
114
PLATE
158
160
SIDES
SIDE
ANGLE
170
168
BRACKET
112
AXIS
162
193
MARKINGS
178
LOCKING HOLES
LOCKING HOLE
182
LOCKING HOLES
LOCKING HOLE
184
180
POSITIONS
POSITION
166
164
HOOK
136
PROJECTING PORTION
PROXIMAL NOTCH
DISTAL NOTCH
SLOT
154
140
142
138
HOOK
130
PROJECTING PORTION
NOTCH
132
134
SLOT
152
LOCKING STRUCTURE
SNAP BUTTON
172
SPRING
BUTTON
176
174
116
194
ANGLED PORTION

ADJUSTABLE ANGLE SHELF BRACKET

BACKGROUND INFORMATION

1. Field

The present disclosure relates generally to methods and apparatus for mounting and supporting a shelf. More particularly, the present disclosure relates to an adjustable bracket assembly and a method for attaching a shelf to a support structure at a number of different angles.

2. Background

A number of different methods and structures for mounting shelves are known. For example, shelves may be mounted on standards that are attached to a vertical surface or supported in another appropriate manner. The standards may include a series of slots. A bracket may be configured with a shelf supporting surface and one or more projections in the form of hooks for engaging selected slots in the standard. A number of such brackets may be used to mount a shelf to such standards.

Current brackets for attaching shelves to slotted standards may have several limitations. For example, in a typical bracket the shelf supporting surface of the bracket extends substantially horizontally from a standard when the bracket is attached to the standard. Such a bracket may not be used to attach a shelf to the bracket at any angle other than horizontally.

Furthermore, not all standards may have the same configuration of slots. The projecting hook portions of a bracket must match the configuration of slots in a standard for the bracket to be used to mount a shelf to the standard. Therefore, the standards with which a bracket with a particular hook configuration may be used may be limited.

Accordingly, it would be advantageous to have a method and apparatus, which takes into account one or more of the issues discussed above as well as possibly other issues.

SUMMARY

In one illustrative embodiment, a bracket assembly for attaching a shelf to a support structure at different angles comprises a bracket, an adjustment structure, and a locking structure. The bracket comprises a shelf support surface and a projecting portion extending from an attachment side of the bracket. The projecting portion includes a notch. The adjustment structure comprises a first side moveable between a first position and a second position. The first side crosses the notch in the projecting portion at a first angle to form a side of the notch at the first angle when the first side is in the first position. The first side crosses the notch in the projecting portion at a second angle to form the side of the notch at the second angle when the first side is in the second position. The first angle is different from the second angle. The locking structure is configured to prevent movement of the adjustment structure when the adjustment structure is in the first position and the second position.

In another embodiment, a bracket for attaching a shelf to a support structure at different angles comprises a shelf support surface, a first projecting portion, and a second projecting portion. The first projecting portion extends from an attachment side of the bracket and includes a notch. The second projecting portion extends from the attachment side of the bracket and includes a proximal notch and a distal notch. The notch in the first projecting portion and the proximal notch in the second projecting portion are positioned on a first line at a first angle with respect to the shelf support surface and the notch in the first projecting portion and the distal notch in the second projecting portion are positioned on a second line at a second angle with respect to the shelf support surface, wherein the first angle is different from the second angle.

In another embodiment, a method of attaching a shelf to a support structure comprises moving an adjustment structure on a bracket to a first position wherein a side of the adjustment structure crosses a notch in a projecting portion extending from an attachment side of the bracket at a first angle to form a proximal side of the notch at the first angle. A locking structure on the bracket is locked to prevent movement of the adjustment structure when the adjustment structure is in the first position. The bracket is attached to the support structure by extending the projecting portion into a slot in the support structure and positioning the notch to engage material of the support structure. The shelf is attached to a shelf support surface of the bracket.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and advantages thereof, will best be understood by reference to the following detailed description of an illustrative embodiment of the present disclosure when read in conjunction with the accompanying drawings, wherein:

FIG. 1 is an illustration of a block diagram of a bracket assembly in accordance with an illustrative embodiment;

DETAILED DESCRIPTION

The different illustrative embodiments recognize and take into account that it may be desirable to mount shelves at various different angles. In an illustrative embodiment, a bracket assembly for attaching a shelf to a slotted support structure is adjustable to attach a shelf to a support structure at different angles.

The different illustrative embodiments also recognize and take into account that different slotted support structures may be made of materials having different thicknesses. In an illustrative embodiment, a bracket assembly for attaching a shelf to a slotted support structure is adjustable for different support structure material thickness.

Figure 2:
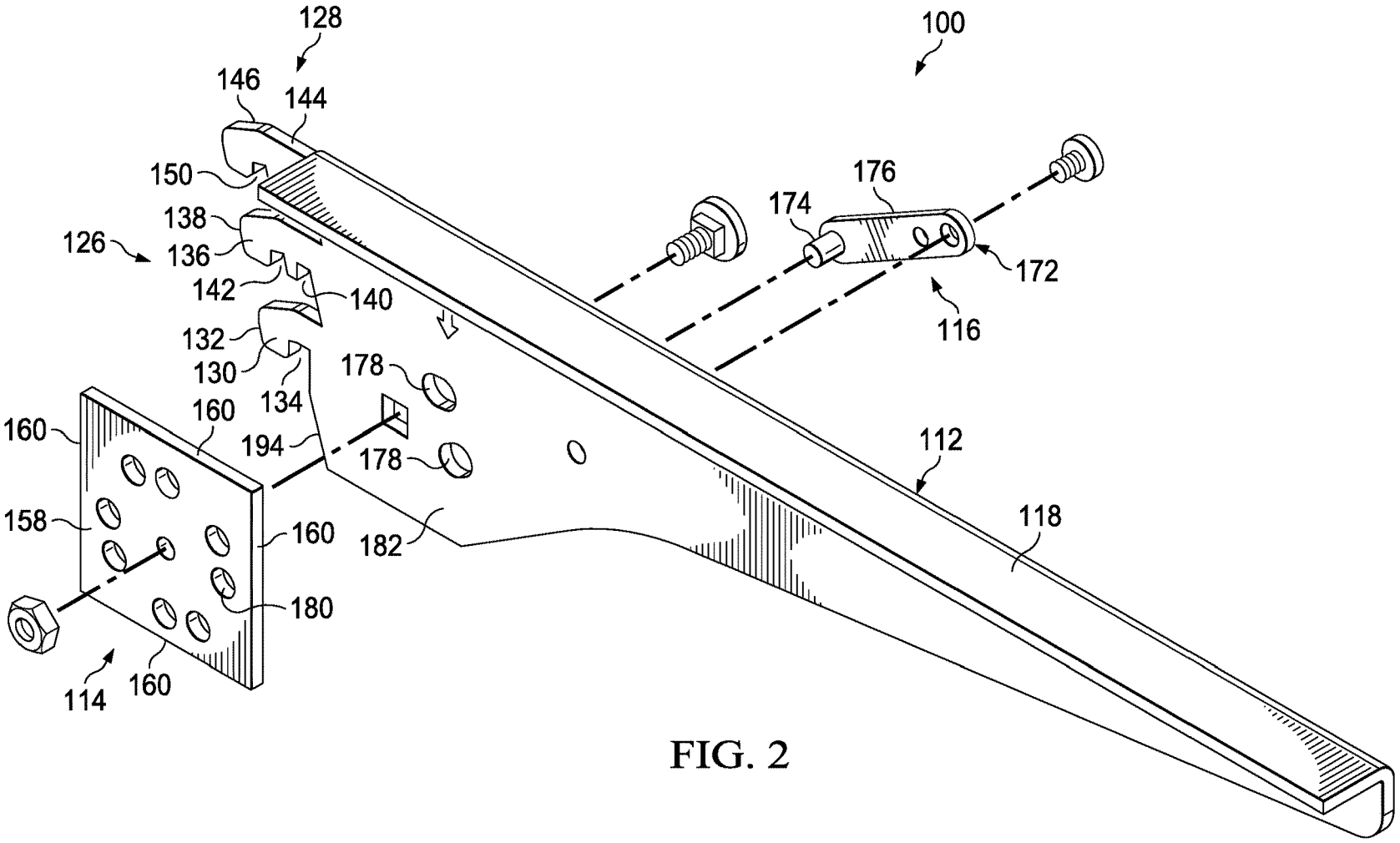
FIG. 2 is an illustration of an exploded perspective view of a bracket assembly in accordance with an illustrative embodiment.
Figure 3:
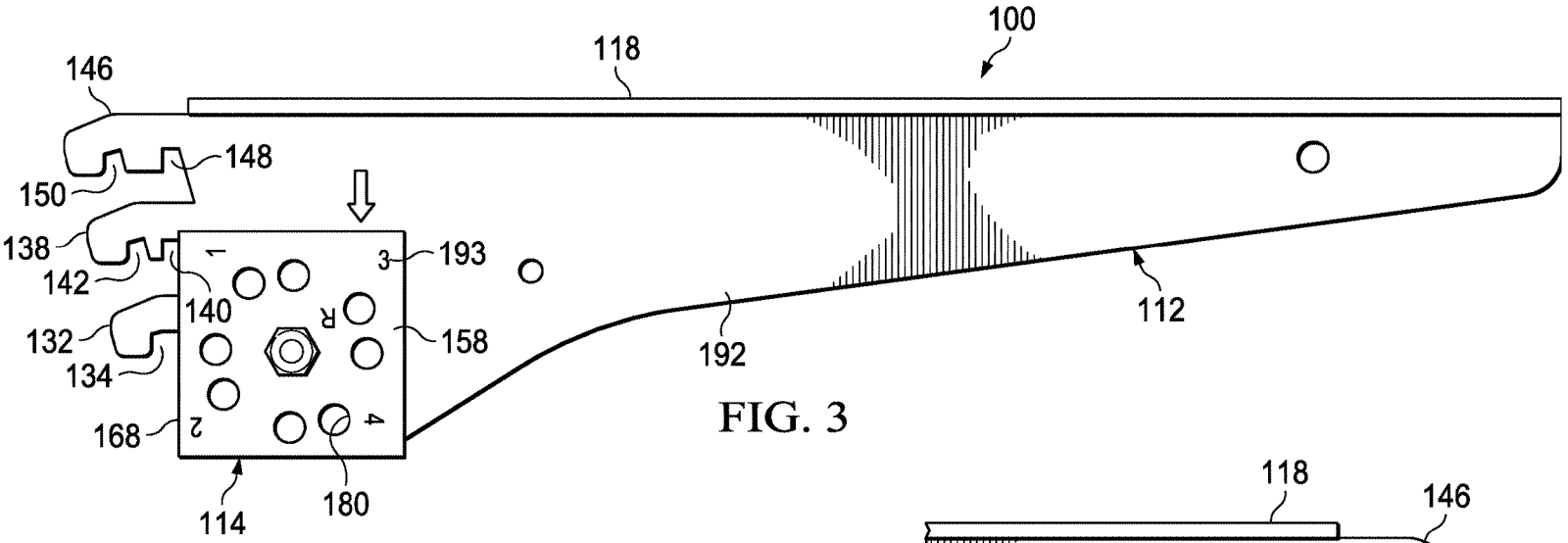
FIG. 3 is an illustration of a side view of a bracket assembly in accordance with an illustrative embodiment.

Turning to FIG. 1, FIG. 2, and FIG. 3, wherein the same reference numerals are used throughout to refer to corresponding structures. FIG. 1 is an illustration of a block diagram of a bracket assembly in accordance with an illustrative embodiment. FIG. 2 is an illustration of an exploded perspective view of a bracket assembly in accordance with an illustrative embodiment. FIG. 3 is an illustration of a side view of a bracket assembly in accordance with an illustrative embodiment.

Figure 6:
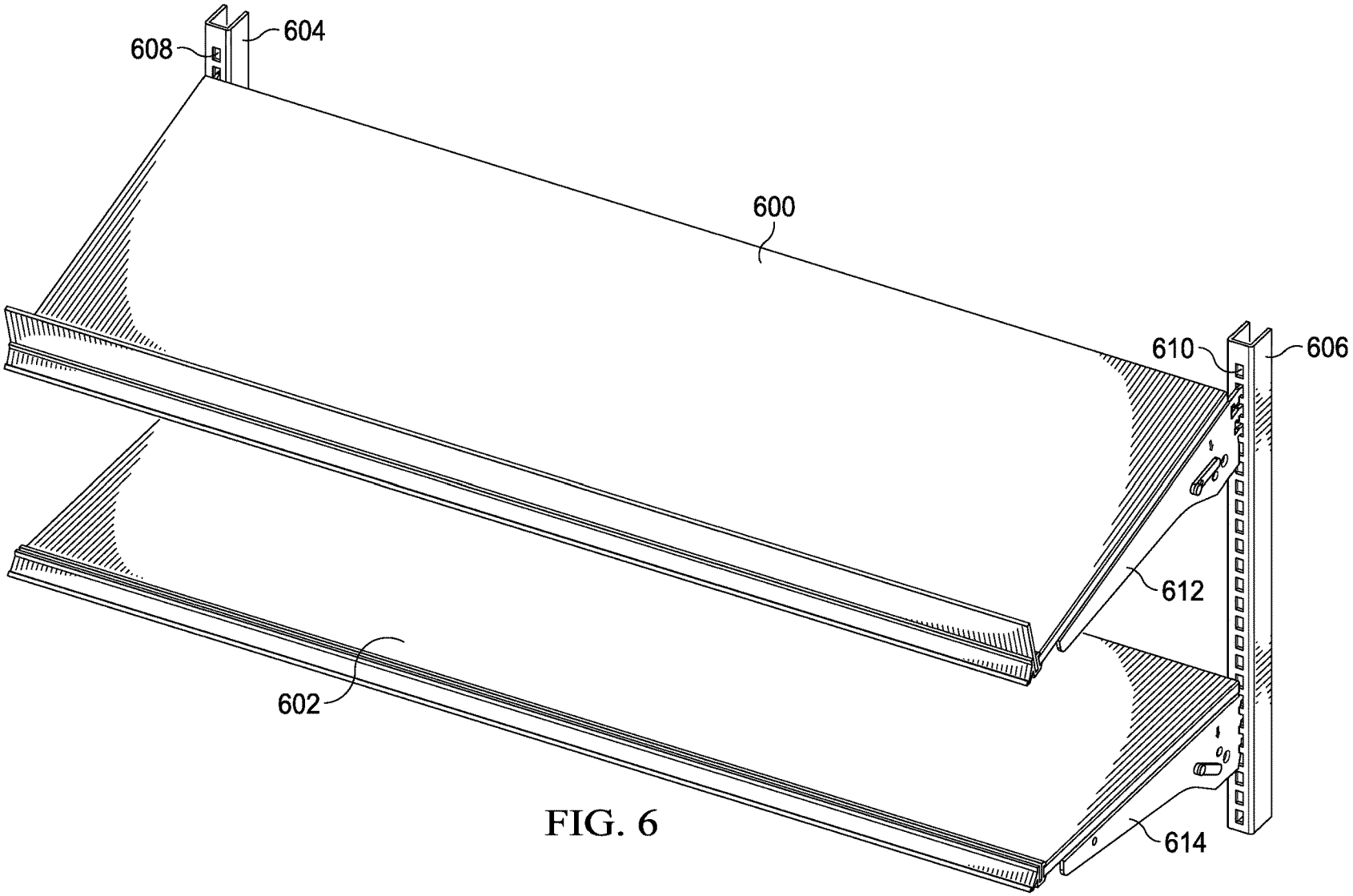
FIG. 6 is a perspective view illustration of shelves mounted to standards using bracket assemblies in accordance with an illustrative embodiment.

Bracket assembly 100 may be configured for mounting shelf 102 to support structure 104 having a number of slots 106. Shelf 600 in FIG. 6 is an example of one implementation of shelf 102. For example, without limitation, support structure 104 may be a standard or other appropriate support structure. Standard 604 and standard 606 in FIG. 6 are examples of support structure 104. Support structure 104 may be made of material 108 having thickness 110.

Bracket assembly 100 comprises bracket 112, adjustment structure 114, and locking structure 116. Bracket 112 includes shelf support surface 118. In accordance with an illustrative embodiment, shelf support surface 118 may be at angle 120 with respect to support structure 104. For example, without limitation, angle 120 may be horizontal 122 or other angle 124. For example, without limitation, other angle 124 may be 15 degrees from horizontal or another appropriate angle.

A number of hooks 126 may extend from attachment side 128 of bracket 112. For example, hook 130 may be formed by projecting portion 132 including notch 134 therein. Hook 130 may be referred to as a first hook and projecting portion 132 may be referred to as a first projecting portion. Hook 136 may be formed by projecting portion 138 having proximal notch 140 and distal notch 142 therein. Hook 136 may be referred to as a second hook and projecting portion 138 may be referred to as a second projecting portion. Hook 144 may be formed by projecting portion 146 having proximal notch 148 and distal notch 150 therein. Hook 144 may be referred to as a third hook and projecting portion 146 may be referred to as a third projecting portion. Hooks 130, 136, and 144 may be engaged in corresponding slots 152, 154, and 156 in support structure 104 to attach bracket assembly 100 to support structure 104. A bracket assembly in accordance with an illustrative embodiment may have more or fewer than three hooks formed by more or fewer than three projecting portions.

Adjustment structure 114 may comprise plate 158 having sides 160. Plate 158 may be attached to bracket 112 in an appropriate manner to provide for rotational movement of plate 158 on axis 162 with respect to bracket 112. Plate 158 may be rotated between various positions 164 to position 166 where side 168 of plate 158 is at angle 170 with respect to notch 134 for the desired angle 120 of shelf 102 and thickness 110 of material 108 of support structure 104.

Locking structure 116 may include snap button 172 including button 174 and spring 176. Snap button 172 may interact with locking holes 178 in bracket 112 and locking holes 180 in plate 158 to prevent movement of plate 158 when plate 158 is in a desired position 166. For example, button 174 may extend through locking hole 182 in bracket 112 and locking hole 184 in plate 158 at the same time to prevent rotation of plate 158 when plate 158 is in position 166. Locking hole 178 in bracket 112 in FIG. 2 is an example of locking hole 182. Locking hole 180 in plate 158 in FIG. 2 is an example of locking hole 184.

Markings 190 on side 192 of bracket 112 and markings 193 on plate 158 in adjustment structure 114 may indicate the appropriate position 166 of plate 158 for a desired angle 120 and thickness 110 of material 108 of support structure 104. For example, without limitation, plate 158 may be positioned in the appropriate position 166 for a desired angle 120 and thickness 110 of material 108 of support structure 104 by aligning selected ones of markings 190 on bracket 112 and markings 193 on plate 158.

Angled portion 194 of bracket 112 may be provided on attachment side 128 of bracket 112 at an end thereof opposite shelf support surface 118. The angle of angled portion 194 from perpendicular to shelf support surface 118 may match other angle 124 such that angled portion 194 is parallel with and in contact with support structure 104 when bracket assembly 100 is used to attach shelf 102 to support structure 104 at other angle 124. Angled portion 194 thus may provide additional support for bracket assembly 100 supporting shelf 102 when bracket assembly 100 is used to attach shelf 102 to support structure 104 at other angle 124.

Figure 4:
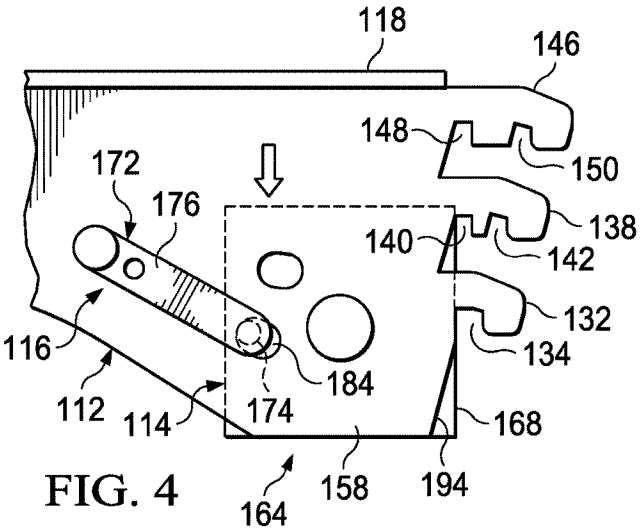
FIG. 4 is an illustration of a side view of a portion of a bracket assembly showing an adjustment structure in a first position accordance with an illustrative embodiment.

Turning to FIG. 4, an illustration of a side view of a portion of a bracket assembly showing an adjustment structure in a first position is depicted in accordance with an illustrative embodiment. In this example, adjustment structure 114 is locked in position by locking structure 116 for supporting a shelf on shelf support surface 118 of bracket 112 in FIG. 3 at a substantially horizontal angle.

Figure 5:
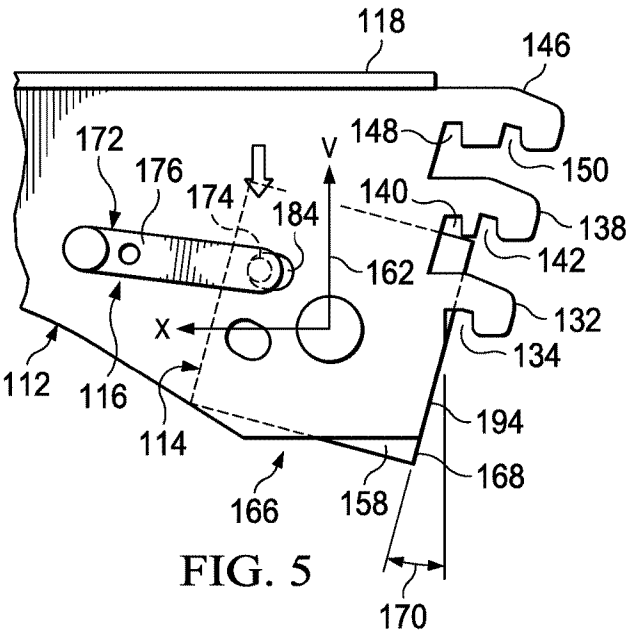
FIG. 5 is an illustration of a side view of a portion of a bracket assembly showing an adjustment structure in a second position accordance with an illustrative embodiment.

Turning to FIG. 5, an illustration of a side view of a portion of a bracket assembly showing an adjustment structure in a second position is depicted in accordance with an illustrative embodiment. In this example, adjustment structure 114 is locked in position by locking structure 116 for supporting a shelf on shelf support surface 118 of bracket 112 in FIG. 3 at approximately a 15 degree angle from horizontal.

Turning to FIG. 6, a perspective view illustration of shelves mounted to support structures using bracket assemblies is depicted in accordance with an illustrative embodiment. In this example, shelf 600 and shelf 602 are examples of shelf 102 in FIG. 1. Standard 604 and standard 606 are examples of support structure 104 in FIG. 1. Standard 604 includes slots 608 therein. Standard 606 includes slots 610 therein. Bracket assemblies 612 and 614 are examples of bracket assembly 100 in FIG. 1.

Figure 7:
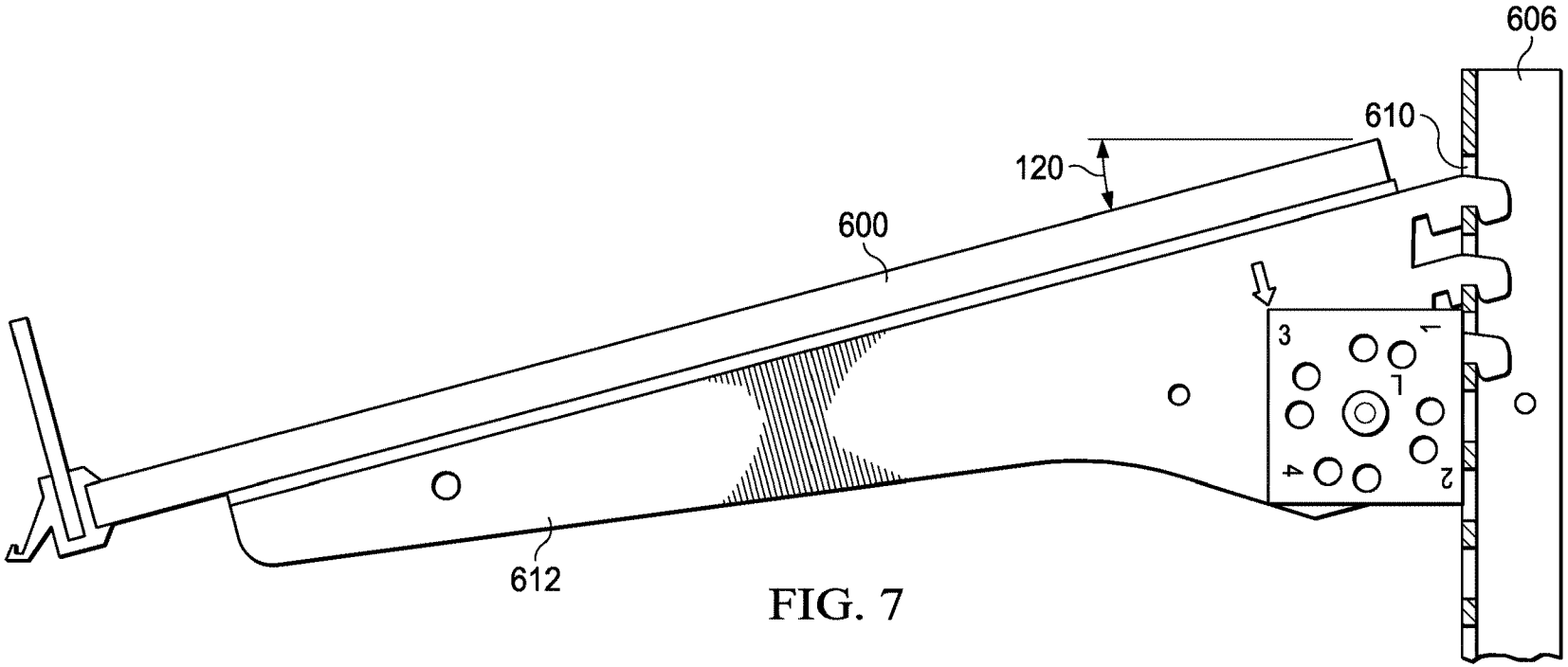
FIG. 7 is a side view in partial cross section of a shelf mounted to a standard at an angle using a bracket assembly in accordance with an illustrative embodiment.

Turning to FIG. 7, a side view illustration in partial cross section of a shelf mounted to a standard at an angle using a bracket assembly is depicted in accordance with an illustrative embodiment. In this example, bracket assembly 612 is configured for attaching shelf 600 to standard 606 in FIG. 6 such that shelf 600 extends at approximately a 15 degree angle from horizontal.

Figure 8:
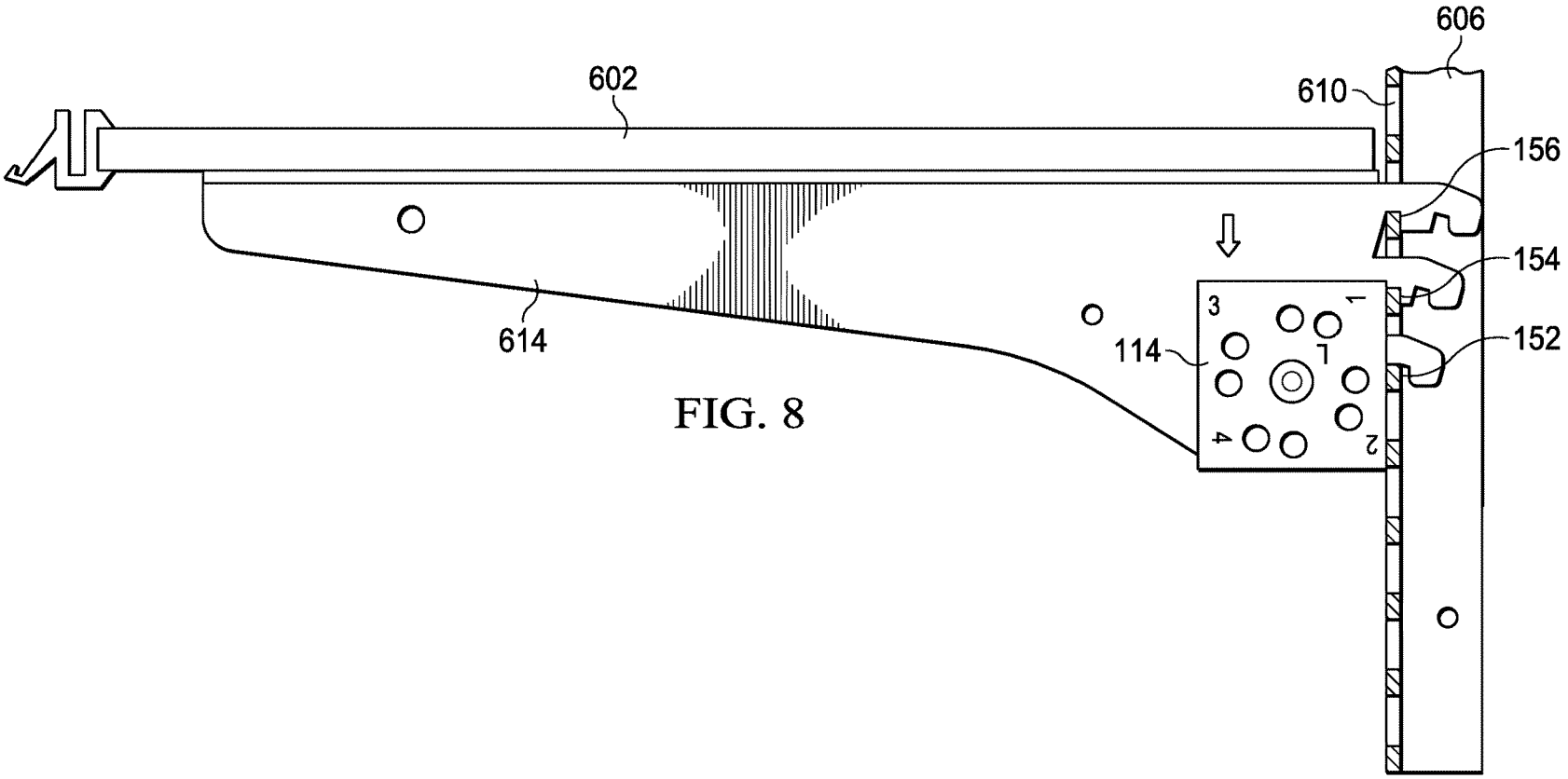
FIG. 8 is a side view in partial cross section of a shelf mounted to a standard at a different angle using a bracket assembly in accordance with an illustrative embodiment.

Turning to FIG. 8, a side view illustration in partial cross section of a shelf mounted to a standard at a different angle using a bracket assembly is depicted in accordance with an illustrative embodiment. In this example, bracket assembly 614 is configured for attaching shelf 602 to standard 606 in FIG. 6 such that shelf 602 extends approximately horizontally.

Figure 9:
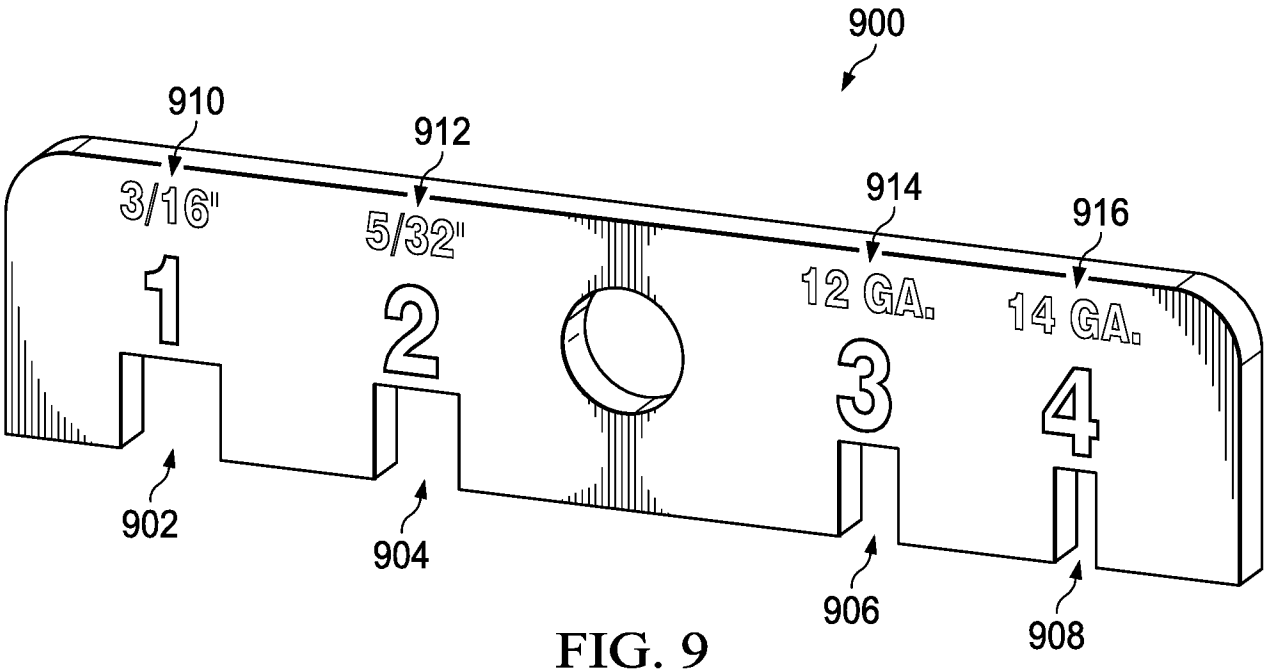
FIG. 9 is a perspective view illustration of a thickness checker for measuring the thickness of material of a standard in accordance with an illustrative embodiment.

Turning to FIG. 9, a perspective view illustration of a thickness checker for measuring the thickness of material of a standard is depicted in accordance with an illustrative embodiment. Thickness checker 900 may include notches 902, 904, 906, and 908, and corresponding markings 910, 912, 914, and 916, respectively for measuring the thickness of material of slots in a standard. Thickness checker 900 thus may be used to select the appropriate position for the adjustment structure of an adjustable bracket assembly in accordance with an illustrative embodiment.

Figure 10:
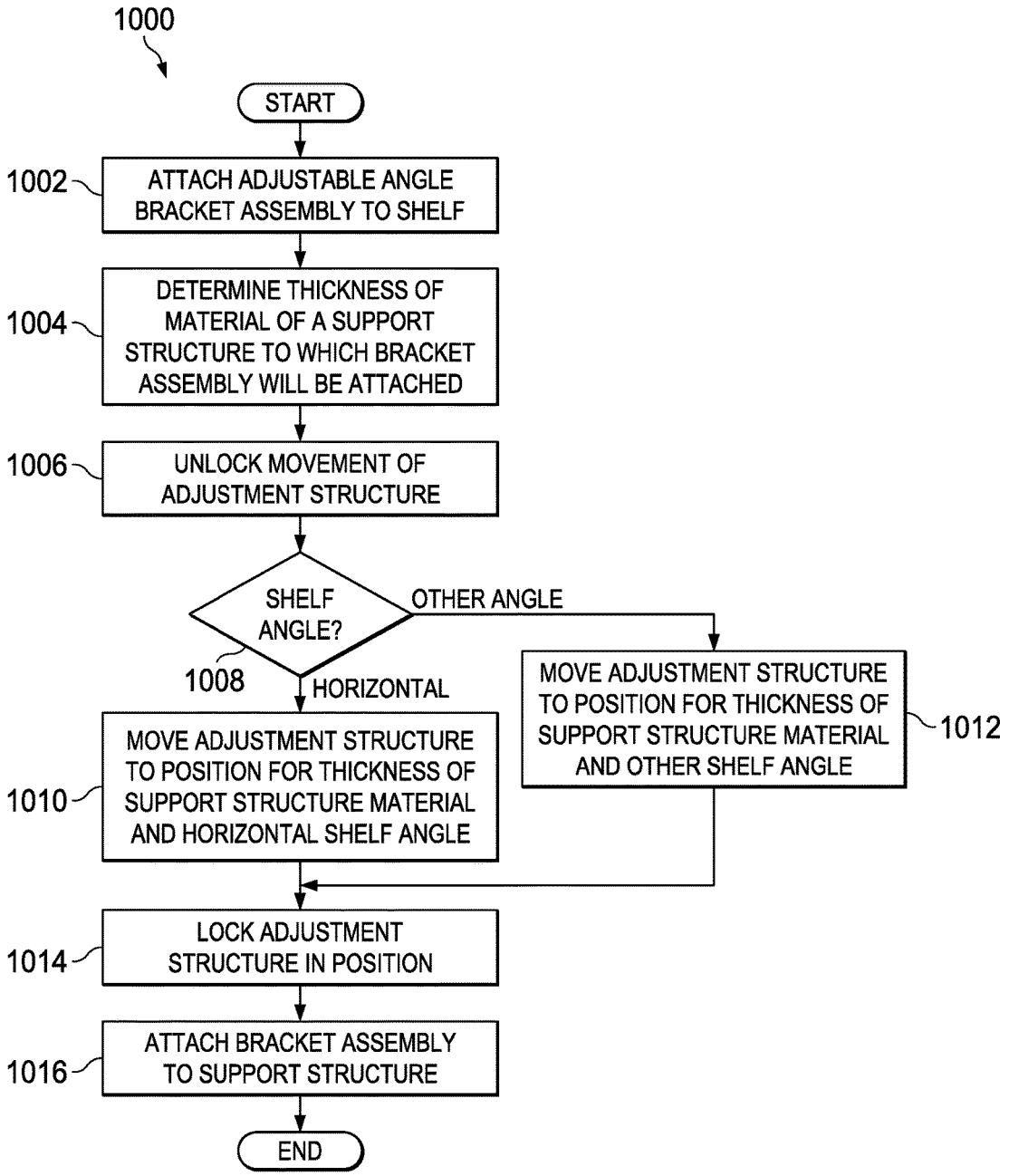
FIG. 10 is an illustration of a flowchart of a method of attaching a shelf to a standard using an adjustable shelf bracket in accordance with an illustrative embodiment.

Turning to FIG. 10, an illustration of a flowchart of a method of attaching a shelf to a support structure using an adjustable shelf bracket is depicted in accordance with an illustrative embodiment. Method 1000 may be implemented, for example, using bracket assembly 100 in FIG. 1 and thickness checker 900 in FIG. 9.

Method 1000 may begin with attaching an adjustable angle bracket assembly in accordance with an illustrative embodiment to a shelf (operation 1002). The thickness of the material of the support structure to which the bracket assembly will be attached may be determined (operation 1004). For example, operation 1004 may be performed by using a thickness checker to determine the thickness of the material of the support structure to which the bracket assembly will be attached. For example, without limitation, thickness checker 900 in FIG. 9 or any other appropriate device or method may be used to determine the thickness of the material of the support structure to which the bracket assembly will be attached.

Movement of an adjustment structure of the bracket assembly may be unlocked (operation 1006). A desired shelf angle may be selected (operation 1008). In response to a determination that the desired shelf angle is horizontal, the adjustment structure is moved to the appropriate position for the thickness of the support structure material determined in operation 1004 and a horizontal shelf angle (operation 1010). In response to a determination that the desired shelf angle is an other angle, the adjustment structure is moved to the appropriate position for the thickness of the support structure material determined in operation 1004 and the other shelf angle (operation 1012). The adjustment structure is then locked in position (operation 1014).

The bracket assembly is then attached to the support structure (operation 1016), with the process terminating thereafter.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other illustrative embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A bracket assembly, comprising:

a bracket comprising a shelf support surface and a first projecting portion extending from an attachment side of the bracket, the first projecting portion including a notch;

an adjustment structure comprising a side moveable between a first position and a second position, wherein in the first position, the side of the adjustment structure is at a first angle with respect to the notch and the shelf support surface is at a first desired shelf angle, wherein in the second position, the side of the adjustment structure is at a second angle with respect to the notch and the shelf support surface is at a second desired shelf angle, wherein the first angle is different from the second angle;

a locking structure configured to lock the adjustment structure to the bracket to prevent movement of the adjustment structure with respect to the bracket when the adjustment structure is in the first position and the second position;

a second projecting portion extending from the attachment side of the bracket, the second projecting portion including a proximal notch and a distal notch, wherein the notch in the first projecting portion and the proximal notch in the second projecting portion are positioned on a first line at the first angle and the notch in the first projecting portion and the distal notch in the second projecting portion are positioned on a second line at the second angle; and a third projecting portion extending from the attachment side of the bracket, the third projecting portion including a second distal notch and a second proximal notch, wherein the proximal notch in the second projecting portion and the second proximal notch in the third projecting portion are positioned on the first line at the first angle and wherein the distal notch in the second projecting portion and the second distal notch in the third projecting portion are positioned on the second line at the second angle.

2. The bracket assembly of claim 1, wherein the first angle is perpendicular to the shelf support surface.

3. The bracket assembly of claim 2, wherein the second angle is approximately 15 degrees from perpendicular to the shelf support surface.

4. A bracket assembly, comprising:

a bracket comprising a shelf support surface;

a first projecting portion extending from an attachment side of the bracket, the first projecting portion including a single notch;

a second projecting portion extending from the attachment side of the bracket, wherein the second projecting portion includes a proximal notch and a distal notch, the single notch in the first projecting portion and the proximal notch in the second projecting portion are positioned on a first line at a first angle, and the single notch in the first projecting portion and the distal notch in the second projecting portion are positioned on a second line at a second angle;

a third projecting portion extending from the attachment side of the bracket, the third projecting portion including a distal notch and a proximal notch, where the proximal notch in the second projecting portion and the proximal notch in the third projecting portion are positioned on the first line at the first angle and the distal notch in the second projecting portion and the distal notch in the third projecting portion are positioned on the second line at the second angle;

an adjustment structure comprising a first side moveable between a first position and a second position, wherein the first side is on the first line with the proximal notch of the second projecting portion and the proximal notch of the third projecting portion at the first angle to form a side of the single notch in the first projecting portion when the adjustment structure is in the first position, and the first side is on the second line with the distal notch of the second projecting portion and the distal notch of the third projecting portion at the second angle to form the side of the single notch in the first projecting portion at the second angle when the first side is in the second position, wherein the first angle is different from the second angle; and a locking structure configured to prevent movement of the adjustment structure when the adjustment structure is in the first position and the second position, wherein the locking structure comprises a button configured to extend at the same time through a first locking hole in the bracket and a first locking hole in the adjustment structure to prevent rotation of the adjustment structure with respect to the bracket when the adjustment structure is in the first position or the second position.

5. The bracket assembly of claim 1, wherein in the first position the first projecting portion and the second projecting portion engage slots in a support structure and the side of the adjustment structure contacts the support structure.

6. The bracket assembly of claim 1, wherein an angled portion of the attachment side of the bracket at an end thereof opposite the shelf support surface is at the second angle, wherein in the second position the first projecting portion and the second projecting portion engage a support structure and the angled portion contacts the support structure.

7. The bracket assembly of claim 1, wherein an angled portion of the attachment side of the bracket at an end thereof opposite the shelf support surface is at the second angle, wherein the second angle is other than perpendicular to the shelf support surface.

8. The bracket assembly of claim 1, wherein the locking structure comprises a button configured to extend simultaneously through a first locking hole in the bracket and a first locking hole in the adjustment structure to prevent rotation of the adjustment structure with respect to the bracket when the adjustment structure is in the first position.

9. The bracket assembly of claim 8, wherein the button is configured to extend simultaneously through a second locking hole in the bracket and a second locking hole in the adjustment structure to prevent rotation of the adjustment structure with respect to the bracket when the adjustment structure is in the second position.

* * * * *